US005195723A

United States Patent [19]

Schauerte et al.

[11] Patent Number: 5,195,723

[45] Date of Patent: Mar. 23, 1993

[54] BALANCED RETENTION VALVE

[75] Inventors: Bruno Schauerte; Ricardo Moreira Seixas, both of Rio de Janeiro, Brazil

[73] Assignee: ABB Vetco Gray (Brasil) S.A., Rio de Janeiro, Brazil

[21] Appl. No.: 889,400

[22] Filed: May 28, 1992

[51] Int. Cl.[5] ..... F16K 1/44

[52] U.S. Cl. ..... 251/282; 251/324; 251/900

[58] Field of Search ..... 251/324, 325, 900, 282

[56] References Cited

U.S. PATENT DOCUMENTS 2,469,921 5/1949 Hoge ..... 251/900 X
4,172,470 10/1979 Walker ..... 251/900 X
4,374,583 2/1983 Barrington ..... 251/324
4,832,081 5/1989 Amrhein et al. ..... 251/900 X

*Primary Examiner*—John Rivell
*Attorney, Agent, or Firm*—Beveridge, DeGrandi, Weilacher & Young

[57] ABSTRACT

A retention balanced valve, particularly for great depth oil prospection, has a plunger and a plunger guide displaceable inside a cylindrical valve body which is closed in one extremity. The plunger provides the sealing of lateral openings of the valve body and covers seal rings. When the plunger is displaced by an external actuation force against the force of a spring, it deobstructs the openings and allows the displacement of the plunger guide until a protection nut associated to the plunger guide covers the sealing rings.

11 Claims, 2 Drawing Sheets

BALANCED RETENTION VALVE

FIELD OF THE INVENTION

The present invention refers to a balanced retention valve, particularly suitable for the annulus of the riser in submarine oil prospection.

STATE OF THE ART

Valves of this type are actuated conventionally in a mechanical manner by the riser-installing tool and by the wet Christmas tree and are applied in great-depth submarine oil prospection.

U.S. Pat. No. 4915175 and 4471841 illustrate models of known valves. The valve of U.S. Pat. No. 4915175 provides protection for sealing rings, whereas U.S. Pat. No. 4471841 proposes a balanced valve so as to reduce the actuating strain, even when it is used under high pressures. These valves are relatively complicated to manufacture and do not achieve the objectives proposed by the present invention fully, as indicated below.

OBJECTS OF THE INVENTION

One of the objectives of the invention is to provide a valve especially suitable for application in great depth, for instance deeper than 1000 meters, which is not affected in its actuation by the hydrostatic column and that is hydrostatically balanced, independently of the utilization depth. Another objective consists in that the sealing elements are not affected by the fluid flow. A further objective consists in maintaining the fluid-passage areas substantially unchanged at several points, so as to avoid a localized increase in speed and consequently localized erosion that can jeopardize the sealing of the valve when it is closed. A forth objective is to avoid the accumulation of debris inside the valve, so as to guarantee the perfect functioning of the valve.. A fifth objective regards the protection of the sealing elements so as to avoid any mechanical damage or wrenching thereof. Finally, a last objective of the invention consists in increasing the safety of the sealing.

BRIEF DESCRIPTION OF THE INVENTION

The proposed invention consists of a valve comprising:

a valve body that is substantially shaped as a cylindrical sleeve with an open end and a closed end, being provided with at least one opening in its side wall and at least one internal sealing ring located inside the valve body between the open end and the said opening;

a first sliding member displaceable inside the valve body under the action of an external actuating force against a first elastic force from a closed position, in which it covers said at least one opening sealingly, to an open position, in which it is away from the opening and from the internal sealing ring towards the closed end of the valve body;

a second sliding member which is also displaceable inside the valve body by virtue of a second elastic force from a closed position, in which it is between the open end of the valve body and the internal sealing ring, to an open position, in which the internal sealing ring does not cover the opening, at least one sealing ring located axially between the opening of the valve body and the closed end thereof and radially between the valve body and the first sliding member, elastic means for providing said first and second elastic forces, a stop surface suitable for stopping the course of the second sliding body in said open position, wherein the second sliding member rests against the first sliding member in the closed position and displaces therewith until it stops against said stop surface, whereafter the first sliding member displaces as far as the respective open position and wherein the space between the first sliding member and the closed end of the valve body is in fluid communication with the open end of the valve body.

Alternatively and more specifically, the inventive valve comprises:

a valve body that is substantially shaped as a cylindrical sleeve with an open end and a closed end, being provided with at least one opening in its side wall and at least one internal sealing ring located inside the valve body between the open end and said opening;

a plunger constituted by an internal portion, an external portion and connecting portions connecting the internal and the external portions together;

a plunger guide comprising an intermediate portion shaped substantially as a cylindrical sleeve, being provided with elongated openings extending over part of the axial length of the plunger guide, the plunger guide being provided at each of its ends with a circumferential bead extending radially outwardly with respect to the external surface of the intermediate portion of the plunger guide;

elastic means for propelling the plunger elastically with respect to the valve body and to the plunger guide in the direction of closing the valve; and a stop located close to the open end of the valve body for limiting the course of the plunger guide towards the open end;

wherein:

the plunger and the plunger guide are sized in such a way that the internal portion of the plunger can slide inside the plunger guide, the external portion of the plunger can slide outside the intermediate portion of the plunger guide, the connecting portions can slide along the elongated openings of the plunger guide and the external portion of the plunger and the circumferential beads can slide tightly inside the valve body;

in the closed position, the plunger is positioned in such a manner that it covers the internal sealing ring and the opening or openings of the valve body, whereas in the open position the plunger is displaced toward the closed end of the valve body, clearing the passage of flow through the opening or openings of the valve body;

in the closed position the plunger rests against said stop and, in the open position, it rests against a stop surface close to the closed end of the valve body, wherein in this position the circumferential bead that is located closer to the open end of the valve body covers the internal sealing ring, but not the opening or openings of the valve body.

DESCRIPTION OF A EMBODIMENT

Figure 1:
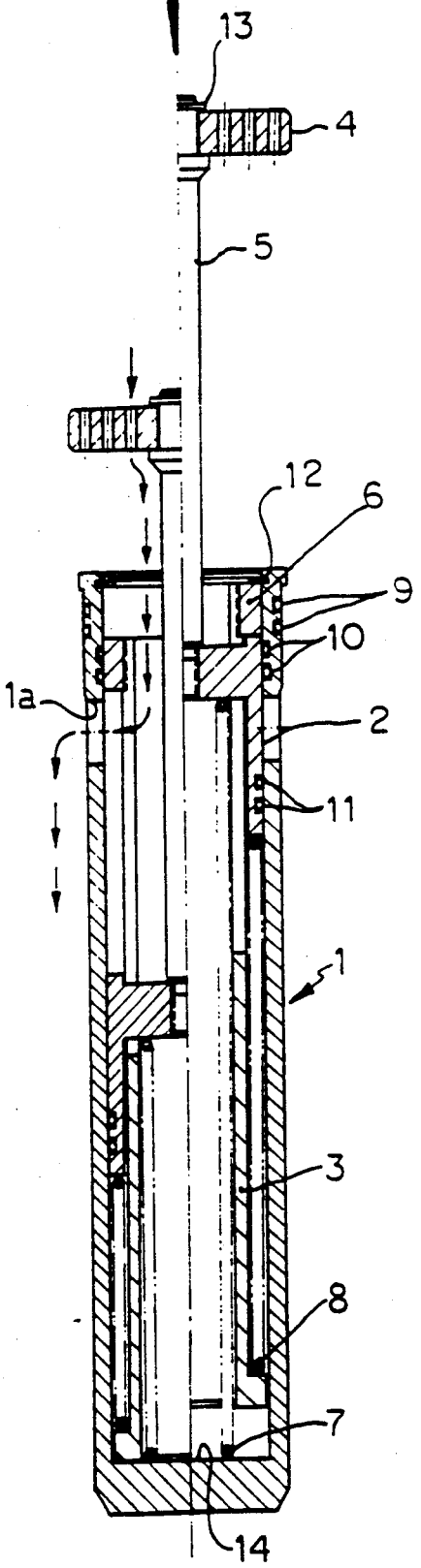
Figure 3A:
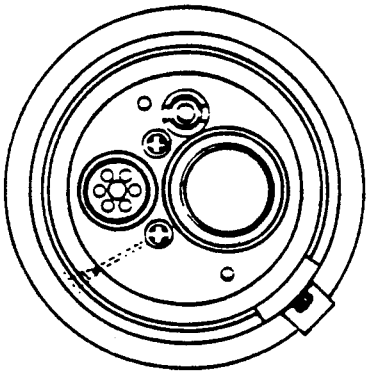
Figure 3:
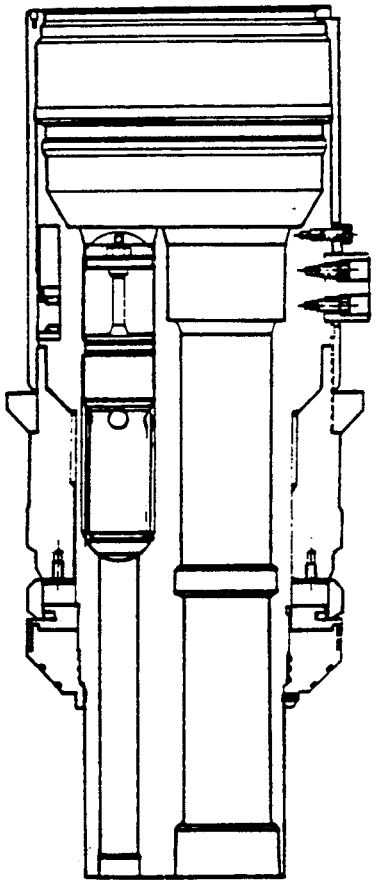
Figure 2:
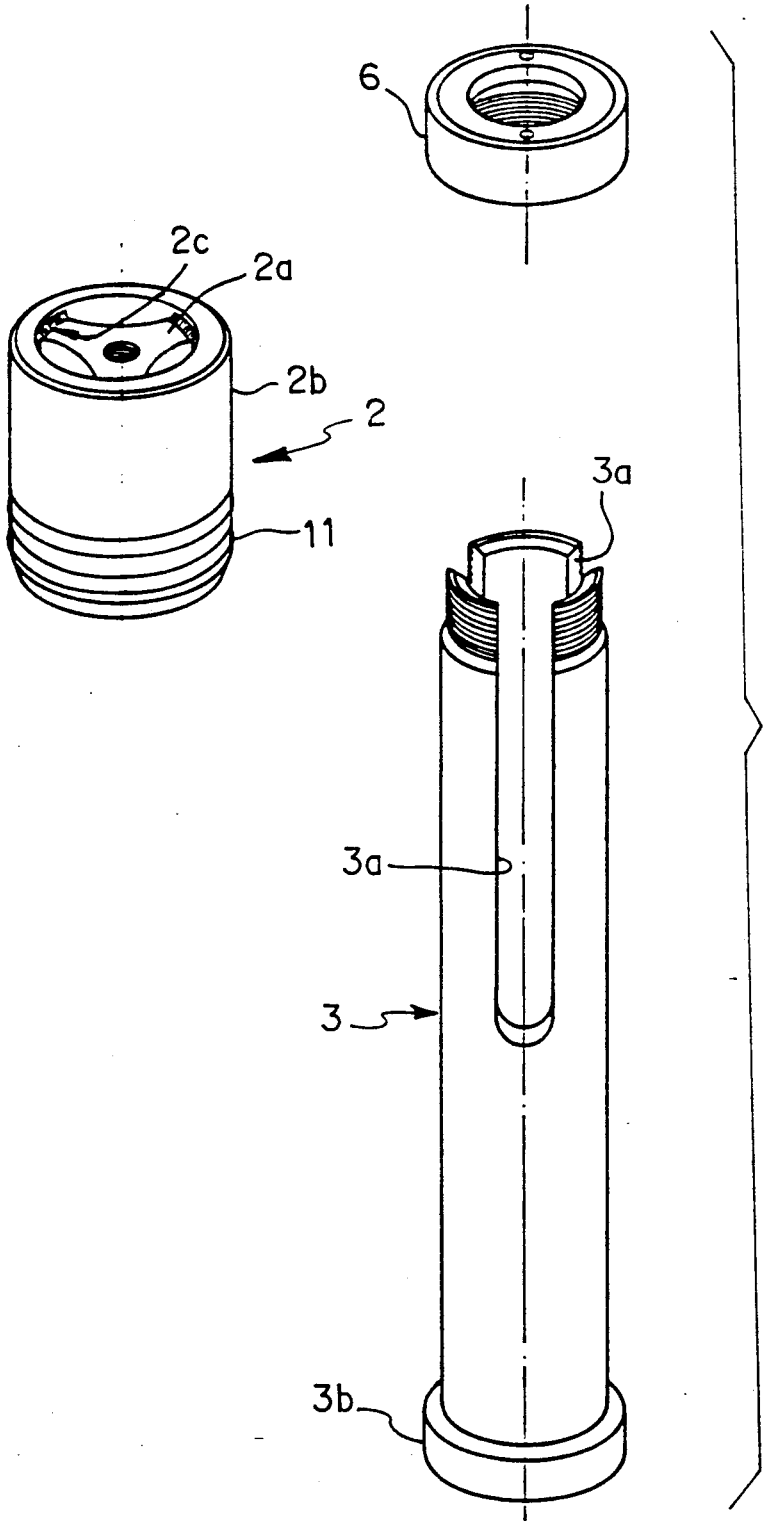

The invention will now be described with reference to the drawings, the figures of which illustrate:

FIG. 1: a sectional side view of an embodiment of the inventive valve, one half of which (the left one) is in the open position and the other (the right one) is in the closed position;

FIG. 2: a perspective view of an embodiment of some components of the valve of FIG. 1;

FIG. 3: a partially sectional side view illustrating the positioning of the valve of the invention within the riser; and FIG. 3a: a top view of FIG. 3.

The valve of FIG. 1 comprises a valve body 1, a plunger 2, a plunger guide 3, a debris retainer 4, a driving stem 5, a protection nut 6, a plunger compression spring 7 a protection-nut compression spring 8, 0-shaped sealing rings 9 of the valve body, O-shaped sealing rings 10 of the double upper sealing, O-shaped sealing rings 11 of the double lower sealing, plunger-retaining ring 12 and debris-retainer retaining ring 13. The double sealing ensures a safer tightness.

The opening of the valve from the totally closed position illustrated in the right half of FIG. 1 as far as the totally open position illustrated in the left half occurs in accordance with the following functional sequence. When the retainer 4 is actuated, the peace set 5, 2, 3 and 6 will pass through the internal area of the valve body 1. Upon reaching the stop at the end of the valve body 1, the plunger guide 3 and, consequently, the protection nut 6 will stop in a determined position that ensures protection of the sealing rings 10, but allowing the plunger 2 to go on its course through the elongated tears of openings 3a existing in the plunger guide 3. In this way plunger 2 will go the whole course imposed by the actuation and will stop in the position of total opening, clearing the openings 1a of the valve body 1 and permitting any injection of fluid from the upper side.

The closing of the valve from the totally open position shown in the left half of FIG. 1 as far as the totally closed position shown in the right half occurs as follows. When the actuation force on the upper side of the valve is withdrawn, spring 7 will displace plunger 2 until the latter reaches the protection nut 6. When the plunger has reached nut 6, the force of spring 8 will maintain them close together, so that they can go on together as far as the totally closed position. Said pieces will displace upwards until protection nut 6 reaches retaining ring 12, in which position the plunger 2 will block passage through the side bores of valve body 1, the sealing being ensured by rings 10 and 11.

Since sealing rings 10 and 11 are permanently covered either by plunger 2 or by protection nut 6, exposition of the rings to the flow of either gas or another fluid is avoided, which could cause erosion thereof and the consequent reduction of their useful life.

As shown in FIG. 1, compression spring 7 is mounted inside the plunger guide 3 and rests against the lower face of an internal portion of plunger 2, resting on a stop surface 14 provided by the closed end of the valve body 1. Compression spring 8 is mounted around plunger guide 2 and rests against the lower face of an external portion of plunger 2, resting on a stop surface provided by a lower flange of plunger guide 3.

Since there is no sealing between plunger 2 and plunger guide 3, the fluid of the line will penetrate the space located below plunger 2. Thus, there is no significant difference in pressure above and below plunger 2 to be overcome when it displaces, whereby a balanced valve is provided, the actuation of which is not dependent upon the height of the liquid column.

FIG. 2 illustrates an embodiment of plunger 2 and plunger guide 3. Plunger 2 comprises an internal portion 2a and an external portion 2b interconnected by connecting portions 2c. As shown, portion 2a is sized so as to slide within plunger guide 3, while external portion 2b slides on the intermediate portion of plunger guide 3, that is to say, on the guide portion of plunger 3 that is located between both circumferential beads 3b and 6. In the example illustrated the lower circumferential bead is a flange 3b of the plunger guide, whereas the upper circumferential bead is a nut 6 that can be screwed onto the upper end of plunger guide 3 after compression spring 8 (FIG. 1) and plunger 2 are engaged.

When the retention valve of the invention is installed in the riser, as shown in FIG. 3, it can be actuated either via a riser tool or via a wet Christmas tree. In both cases, the valve should assume the open position illustrated in the left half of FIG. 1.

Debris retainer 4 will ensures, through its narrow openings, that no solid debris of a considerable size can pass into valve body 1. The O-shaped sealing rings 10 and 11 provided in pairs will ensure a greater degree of reliability as regards tightness of the valve in the closed position; in the open position they are protected with respect to the fluid that flows through the valve, which will ensure longer useful life for them. Another advantage results from the fact that the proposed valve is not affected by the hydrostatic column, so that the actuation pressure will remain basically unchanged, whether the valve is utilized close to the surface or in great depths. Associated with the advantages indicated above, it should be noted that the proposed valve presents a relatively simple constructivity, so that its manufacture is accordingly simple and inexpensive. Besides, a good tightness will be ensured by providing a pair of sealing rings above and below the openings of the valve body.

We claim:

1. A balanced retention valve, particularly for the annulus of a riser in submarine oil prospection in great depth, comprising:

a valve body shaped substantially as a cylindrical sleeve with an open end and a closed end, being provided with at least one opening in its side wall and at least one internal sealing ring located inside the valve body between the open end and said opening;

a first sliding member displaceable inside the valve body under an external actuation force against a first elastic force from the closed position, in which it covers both said at least one opening sealingly and the internal sealing ring of the valve body to an open position, in which it is away from said opening and from the internal sealing ring towards the closed end of the valve body, a second sliding member also displaceable inside the valve body, by virtue of a second elastic force from a closed position, in which it is located between the open end of the valve body and the first sliding member, to an open position, in which it covers the internal sealing ring, but does not cover said opening, at least one sealing ring located axially between the opening of the valve body and the closed end thereof and radially between the valve body and the first sliding member, elastic means for providing said first and second elastic forces, a stop surface suitable for stopping the course of said second sliding member in said open position, wherein the second sliding member rests against the first sliding member in the closed position and displaces together therewith until it stops against said stop surface, whereafter the first sliding member displaces as far as the respective open position, and wherein a space between the first sliding member and the closed end of the valve body is in fluid communication with the open end of the valve body.

2. A valve in accordance with claim 1, wherein the first sliding member is a plunger constituted by an internal portion, an external portion and connecting portions connecting the internal and external portions together, the second sliding member being a plunger guide comprising an intermediate portion shaped substantially as a cylindrical sleeve, being provided with elongated openings extending over part of the axial length of the plunger guide, the plunger guide being provided, at least at its end facing the open end of the valve body, with a circumferential bead extending radially outwards with respect to the external surface of the intermediate portion of the plunger guide, the plunger and the plunger guide being sized in such a way that the internal portion of the plunger can slide inside the plunger guide, the external portion of the plunger can slide outside the intermediate portion of the plunger guide, connecting portions can slide along the elongated openings of the plunger guide and the external portion of the plunger and the circumferential bead can slide tightly inside the valve body.

3. A balanced retention valve particularly for the annulus of submarine oil prospection in great depth, comprising:

a valve body shaped substantially as a cylindrical sleeve with an open end and a closed end, being provided with at least one opening in its side wall and at least one internal sealing ring located inside the valve body between the open end and said opening;

a plunger constituted by an internal portion, an external portion and connecting portions connecting the internal and the external portions together;

a plunger guide comprising an intermediate portion shaped substantially as a cylindrical sleeve, being provided with elongated openings extending over part of the axial length of the plunger guide, said plunger guide being provided at opposite ends with a respective circumferential bead extending radially outwards with respect to the external surface of the intermediate portion of said plunger guide;

elastic means for propelling said plunger elastically with respect to said valve body and with respect to said plunger guide in the direction of closing of the valve; and a stop located close to the open end of said valve body for limiting the course of said plunger guide towards the open end;

wherein:

said plunger and plunger guide are sized in such a manner that the internal portion of said plunger can slide inside the plunger guide, the external portion of said plunger can slide outside the intermediate portion of the plunger guide, the connecting portions can slide along the elongated openings of the plunger guide and the external portion of said plunger and circumferential beads can slide tightly inside the valve body; and in the closed position said plunger is positioned in such a manner that it covers said internal sealing ring and said opening or openings of the valve body, whereas in the open position said plunger is displaced towards the closed end of the valve body, for flow through said opening or openings of said valve body; and in the closed position said plunger guide rests against said stop and, in the open position against a stop surface close to the closed end of said valve body, wherein, in this position, one of said circumferential beads, which is located closer to the open end of the valve body covers said internal sealing ring, but not said opening or openings of said valve body.

4. A valve in accordance with claim 3, wherein said elastic means are compression springs, one of which is mounted between said internal portion of said plunger and the closed end of said valve body, within the plunger guide, and the other being mounted around the intermediate portion of said plunger guide between a lower end face of the external portion of said plunger and a top face of another of said circumferential beads closer to the closed end of said valve body.

5. A valve in accordance with claim 3, wherein an actuating stem has two ends, one of which is screwed into a corresponding perforation provided in said plunger, and at the opposite end there is provided a debris retainer shaped as a perforated disc.

6. A valve in accordance with claim 3, wherein said one of said circumferential beads of said plunger guide, which is located close to the open end of said valve body, is a nut screwable onto said plunger guide.

7. A valve in accordance with claim 3, wherein said plunger is equipped with at least one external sealing ring at its periphery, which, in the closed position, is located between said opening or openings of said valve body and the closed end thereof.

8. A valve in accordance with claim 7, wherein two sealing rings are provided inside the valve body and outside said plunger guide.

9. A valve in accordance with claim 3, wherein said stop of said valve body is a retention ring.

10. A valve in accordance with claim 3, wherein two external sealing rings are provided inside the valve body close to its closed end.

11. A valve in accordance with claim 3, wherein two sealing rings are provided inside the valve body and outside said plunger guide.

* * * * *